US010413058B2

(12) United States Patent
Kuhn

(10) Patent No.: US 10,413,058 B2
(45) Date of Patent: Sep. 17, 2019

(54) BATHROOM APPLIANCE STORAGE DEVICE

(71) Applicant: Monica Kuhn, Idaho Falls, ID (US)

(72) Inventor: Monica Kuhn, Idaho Falls, ID (US)

( * ) Notice: Subject to any disclaimer, the term of this patent is extended or adjusted under 35 U.S.C. 154(b) by 0 days.

(21) Appl. No.: 15/963,953

(22) Filed: Apr. 26, 2018

(65) Prior Publication Data

US 2018/0310711 A1 Nov. 1, 2018

Related U.S. Application Data

(60) Provisional application No. 62/490,458, filed on Apr. 26, 2017.

(51) Int. Cl.

| | |
|---|---|
| ***A47B 81/00*** | (2006.01) |
| ***A47B 88/919*** | (2017.01) |
| ***A47B 67/00*** | (2006.01) |
| ***A47B 88/433*** | (2017.01) |
| ***A47B 88/407*** | (2017.01) |

(Continued)

(52) U.S. Cl.

CPC ..... *A47B 81/00* (2013.01); *A47B 67/005* (2013.01); *A47B 67/02* (2013.01); *A47B 88/407* (2017.01); *A47B 88/433* (2017.01); *A47B 88/437* (2017.01); *A47B 88/90* (2017.01); *A47B 88/919* (2017.01); *A47B 2088/401* (2017.01); *A47B 2088/901* (2017.01); *A47B 2220/0047* (2013.01); *A47B 2220/0091* (2013.01); *A47K 17/00* (2013.01)

(58) Field of Classification Search

CPC ... A47B 88/919; A47B 88/407; A47B 88/433; A47B 88/437; A47B 67/005; A47B 2088/901; A47B 2088/401; A47B 2220/0047; A47B 2220/0091; A47B 88/969; A47B 61/00; A47B 61/02; A47B 46/00; A47B 2210/0056; A47B 88/10; A47B 2210/0037; A47B 2210/175; A47B 2210/0024; A47B 73/002; A47B 73/008; A47B 81/00; A47B 88/90; A47B 67/02; A47L 15/501; A47L 15/507; A47F 3/063; A47F 3/06; A47F 3/147; A47F 5/0093; A47F 5/01; A47F 5/0062; A47K 17/00

USPC ... 211/119.009, 126.15, 126.9, 133.5, 133.2, 211/133.6, 41.4, 151, 153, 126.7, 126.8, 211/181.1, 162, 75, 41.8, 41.9; 312/334.6, 334.15, 334.18, 223.6, 140.3, 312/310, 311, 319.2, 319.3; 206/202, 206/427, 576, 349; 132/315, 316, 287, 132/314

See application file for complete search history.

(56) References Cited

U.S. PATENT DOCUMENTS 515,353 A * 2/1894 McIntosh, Sr. ..... F24B 15/00 220/2

1,651,898 A * 12/1927 Maillard ..... A45C 5/005 132/288

(Continued)

*Primary Examiner* — Jennifer E. Novosad

(74) *Attorney, Agent, or Firm* — Schmeiser, Olsen & Watts LLP

(57) ABSTRACT

Disclosed is a bathroom appliance storage device for conveniently storing and allowing easy access to bathroom appliance such as blow dryers, curling irons, straighteners, hairbrushes and the like. A bathroom appliance storage device includes a rack, wherein the rack includes: at least one ring holder; at least one tube holder; and a handle. A movable support is removably coupled to the rack. At least one track is coupled to the movable support.

20 Claims, 5 Drawing Sheets

(51) Int. Cl.

| | |
|---|---|
| ***A47B 88/90*** | (2017.01) |
| ***A47B 88/437*** | (2017.01) |
| ***A47B 67/02*** | (2006.01) |
| ***A47K 17/00*** | (2006.01) |
| ***A47B 88/40*** | (2017.01) |

(56) References Cited

U.S. PATENT DOCUMENTS 1,752,948 A * 4/1930 Herrmann ..... A45C 13/02 132/287
2,005,938 A * 6/1935 Graves ..... C12L 11/00 211/134
2,367,218 A * 1/1945 Joyce, Jr. ..... A43D 117/00 211/181.1
2,406,756 A * 9/1946 Fox ..... B65D 71/0011 206/202
2,946,458 A * 7/1960 Miller ..... A47B 77/14 211/162
2,971,655 A * 2/1961 Miller ..... A47B 88/49 211/126.15
2,981,440 A * 4/1961 Lilja ..... B65D 71/0003 206/202
3,037,658 A * 6/1962 Schray ..... B65D 77/04 206/144
3,069,020 A * 12/1962 Sans ..... A47B 61/04 211/162
3,114,459 A * 12/1963 Kersting ..... A47B 81/067 211/181.1
3,433,383 A * 3/1969 Phibbs ..... B65D 21/086 206/162
3,684,102 A * 8/1972 Colter ..... A47B 63/00 211/88.01
3,893,607 A * 7/1975 Jones ..... A45C 3/00 206/576
3,966,103 A * 6/1976 Abrams ..... A47G 19/30 294/144
4,446,972 A * 5/1984 Sussman ..... A47G 29/08 211/26
4,697,711 A * 10/1987 Noren ..... A47L 15/247 134/25.2
4,730,799 A * 3/1988 Foss ..... B25H 3/006 211/106
4,913,298 A * 4/1990 Compagnucci ..... A47B 77/16 211/162
4,995,682 A * 2/1991 Gutner ..... G11B 23/0236 206/387.15
5,083,848 A * 1/1992 Merino ..... A47B 77/10 312/334.42
5,086,936 A * 2/1992 Remmers ..... A47B 67/04 211/126.15
5,124,532 A * 6/1992 Hafey ..... A45D 1/00 132/229
5,150,784 A * 9/1992 Sayad ..... B65D 71/0003 206/202
5,230,554 A * 7/1993 Camilleri ..... A47B 88/40 312/334.31
5,303,997 A * 4/1994 Kropf ..... A47B 88/402 312/334.4
5,330,063 A * 7/1994 Remmers ..... A47B 88/402 211/126.15
5,577,819 A * 11/1996 Olsen ..... A47B 67/00 312/209
5,615,782 A * 4/1997 Choe ..... A45D 1/00 211/60.1
D385,136 S * 10/1997 Gutke ..... D6/524
5,794,799 A * 8/1998 Collins ..... A45D 1/20 211/60.1
5,875,794 A * 3/1999 Ekman ..... A45C 5/005 132/287
5,917,694 A * 6/1999 Denny ..... A45D 1/00 206/372
6,039,422 A * 3/2000 Butters ..... A47B 45/00 16/422
6,109,446 A * 8/2000 Foote ..... A45D 44/04 206/372
D445,766 S * 7/2001 Solomon ..... D13/199
6,702,608 B2 * 3/2004 Brennan, Jr. ..... B25H 3/00 280/47.19
6,745,895 B2 * 6/2004 Silvers ..... B65D 1/36 206/233
6,769,554 B1 * 8/2004 Udofiah ..... A45D 44/06 211/26.2
7,188,629 B2 * 3/2007 Mehes ..... A46B 17/00 132/310
7,469,792 B1 * 12/2008 Lin ..... A47B 73/002 211/74
D603,095 S * 10/2009 Petruccelli ..... D28/38
7,624,886 B2 * 12/2009 Huang ..... A45C 5/045 220/507
D628,388 S * 12/2010 Klein ..... D3/318
7,886,917 B1 * 2/2011 Berger ..... A47B 45/00 211/133.5
7,909,162 B1 * 3/2011 Barrett ..... A45C 11/00 132/286
7,992,728 B2 * 8/2011 Burgess ..... A47F 5/0056 211/126.15
D662,712 S * 7/2012 Rodriguez ..... D3/310
8,689,999 B2 * 4/2014 Cooper ..... A45D 44/04 206/581
8,869,996 B1 * 10/2014 Christenson ..... A47F 7/0028 211/119.009
9,013,071 B1 * 4/2015 Levi ..... A45D 44/02 191/12 R
9,949,554 B2 * 4/2018 Sullivan ..... A47F 5/08
10,039,358 B2 * 8/2018 Hanson ..... A45C 11/00
2003/0000864 A1 * 1/2003 Carraro ..... A62C 13/78 206/576
2006/0267467 A1 * 11/2006 Harbison ..... A47B 51/00 312/331
2007/0159040 A1 * 7/2007 Fernandez ..... B25H 3/023 312/348.3
2008/0128306 A1 * 6/2008 Bateman ..... A47F 13/00 206/391
2009/0236958 A1 * 9/2009 Klein ..... A47B 87/0223 312/332.1
2010/0133218 A1 * 6/2010 Yang ..... A47K 3/281 211/119.009
2013/0088134 A1 * 4/2013 Varner ..... A47B 88/40 312/348.1
2014/0197121 A1 * 7/2014 Knight ..... A47B 45/00 211/86.01
2018/0310711 A1 * 11/2018 Kuhn ..... A47B 88/919

* cited by examiner

BATHROOM APPLIANCE STORAGE DEVICE

CROSS REFERENCE TO RELATED APPLICATIONS

This application claims priority to U.S. Provisional Patent Application Ser. No. 62/490,458, filed on Apr. 26, 2017, the disclosure of which is hereby incorporated entirely herein by reference.

BACKGROUND OF THE INVENTION

Technical Field

This invention relates to a device and method of use for a bathroom appliance storage device.

State of the Art

Often people have multiple bathroom appliances such as curling irons, straightening irons, blow dryers, and the like. Additionally, people may have many different combs, hairbrushes, hair products and other beauty products that need to be stored and accessed conveniently.

Bathrooms, however, are equipped with drawers and cupboards. When bathroom appliances and beauty products are stored in drawers and cupboards, cords get tangled and items often get misplaced.

Tangled cords can result in broken appliances as the appliances may be dropped or fall when other appliances are being removed from storage.

Additionally, hot blow dryers and curling irons can damage drawers and cupboards and are potential fire hazards.

Accordingly, an invention is needed to provide storage for bathroom appliances and beauty products that is safe, organized, and easily accessible.

SUMMARY OF EMBODIMENTS

The present invention discloses a bathroom appliance storage device, including a method of use.

Disclosed is a bathroom appliance storage device including a rack, wherein the rack comprises at least one ring holder; at least one tube holder; and a handle. A movable support is removably coupled to the rack. At least one track is coupled to the movable support.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
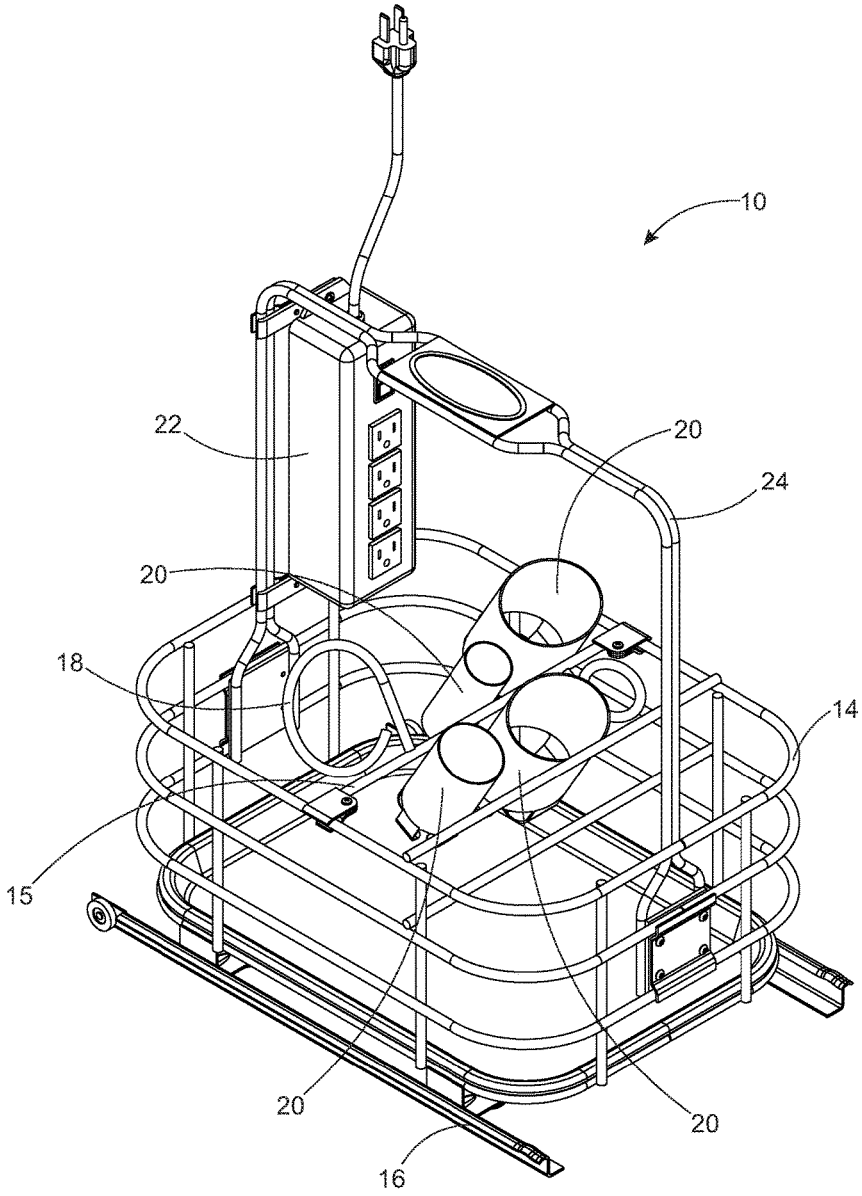
FIG. 1 is a perspective view of a bathroom appliance storage device, in accordance with an embodiment.
Figure 2:
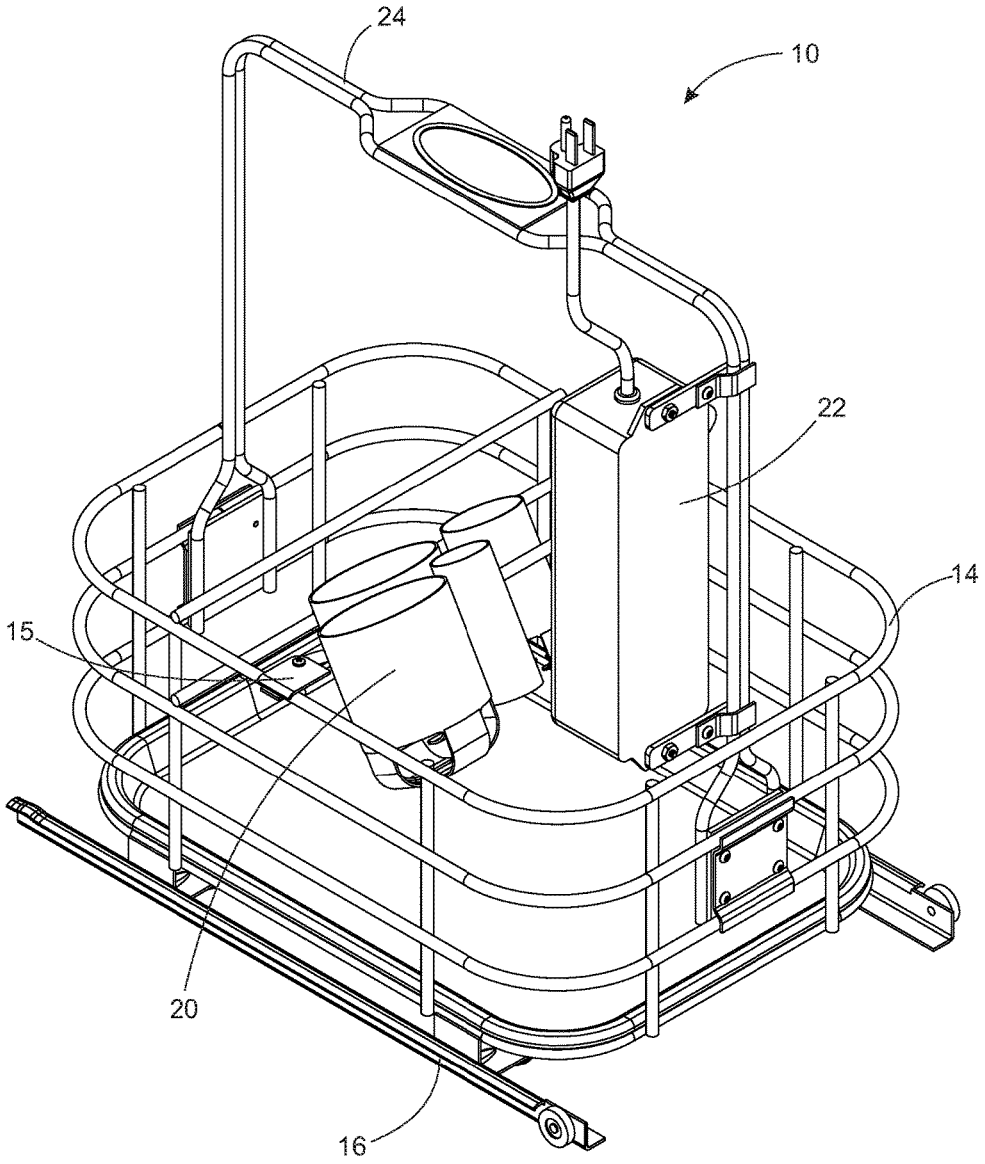
FIG. 2 is an alternative perspective view of a bathroom appliance storage device, in accordance with an embodiment.

Embodiments of this invention disclose a bathroom appliance and product holder that mounts in a cabinet or drawer and which pulls out for easy access while allowing for organized, safe storage for bathroom appliances and products. A bathroom appliance storage device as described includes a rack which holds multiple appliances. The rack is removably coupled or placed on a movable support. The movable support is a shelf that slides in and out of a cupboard on a set of tracks. The rack sets on the movable support and may be lifted off the movable support through use of a handle at the top of the rack.

FIGS. 1-5 illustrate a bathroom appliance storage device 10 having a rack 14. Rack 14, as illustrated includes a metal frame having four low sides, a bottom and a handle 24. Rack 14 is the portion of the bathroom appliance storage device 10 which stores bathroom appliances, bathroom products, hair brushes and the like.

The rack 14 may be formed from any material desirable such as metal, plastic, wood, glass, ceramic or the like. It is desirable, however, to form the rack 14 from a material that will not melt, burn or deform when exposed to the heat of a blow dryer, curling iron or the like.

The rack 14 may also be formed in any shape desired. The rack 14 illustrated is formed in a shape similar to a basket or tray. The rack 14, however, may have higher sides or no sides at all. Additionally, the rack 14 may have a solid bottom, an open wire bottom, a mesh bottom, or the like. In alternate embodiments, the rack 14 may not have a bottom.

The rack 14 also includes at least on appliance storage device. An open ring holder 18 may be used to hold blow dryers. The open ring holder 18 is a ring mounted to the rack 14 at an elevation which allows the end of a blow dryer to extend through the ring without abutting the bottom of the rack 14. The open ring holder 18 may be a full ring, U-shaped, C-shaped, a partial ring or any other shape that will support a blow dryer or other bathroom appliance.

The rack 14 also includes sleeve holders 20. Sleeve holders 20 are hollow cylindrical shaped holders that are mounted at an angle in the rack 14. The sleeve holders 20 may have a closed or open bottom. Additionally, the sleeve holders 20 may have different diameters in order to hold different sized appliances. Sleeve holders 20 are ideal for holding curling irons and the like.

Figure 3:
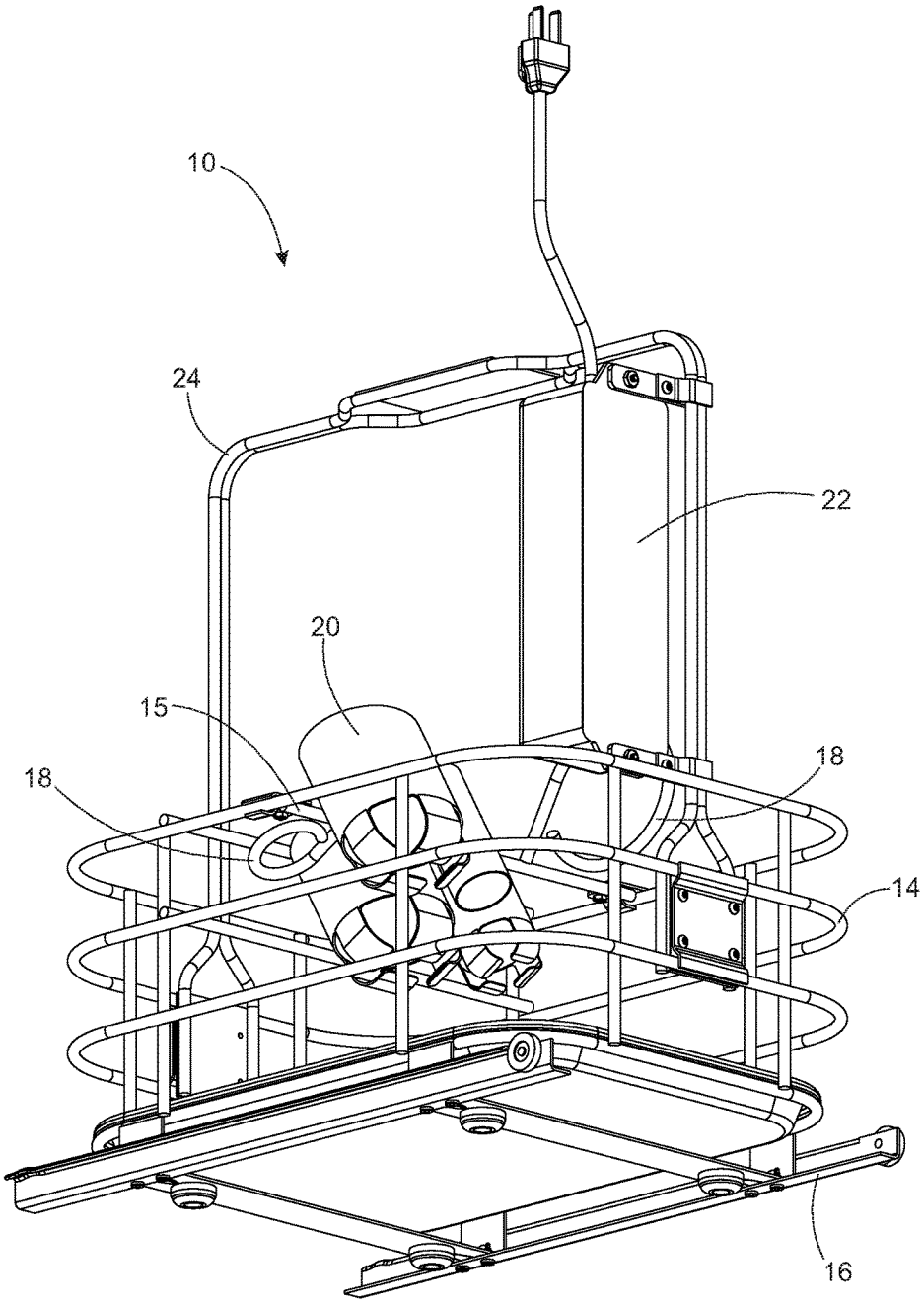
FIG. 3 is another alternative perspective view of a bathroom appliance storage device showing the bottom of the device, in accordance with an embodiment.
Figure 4:
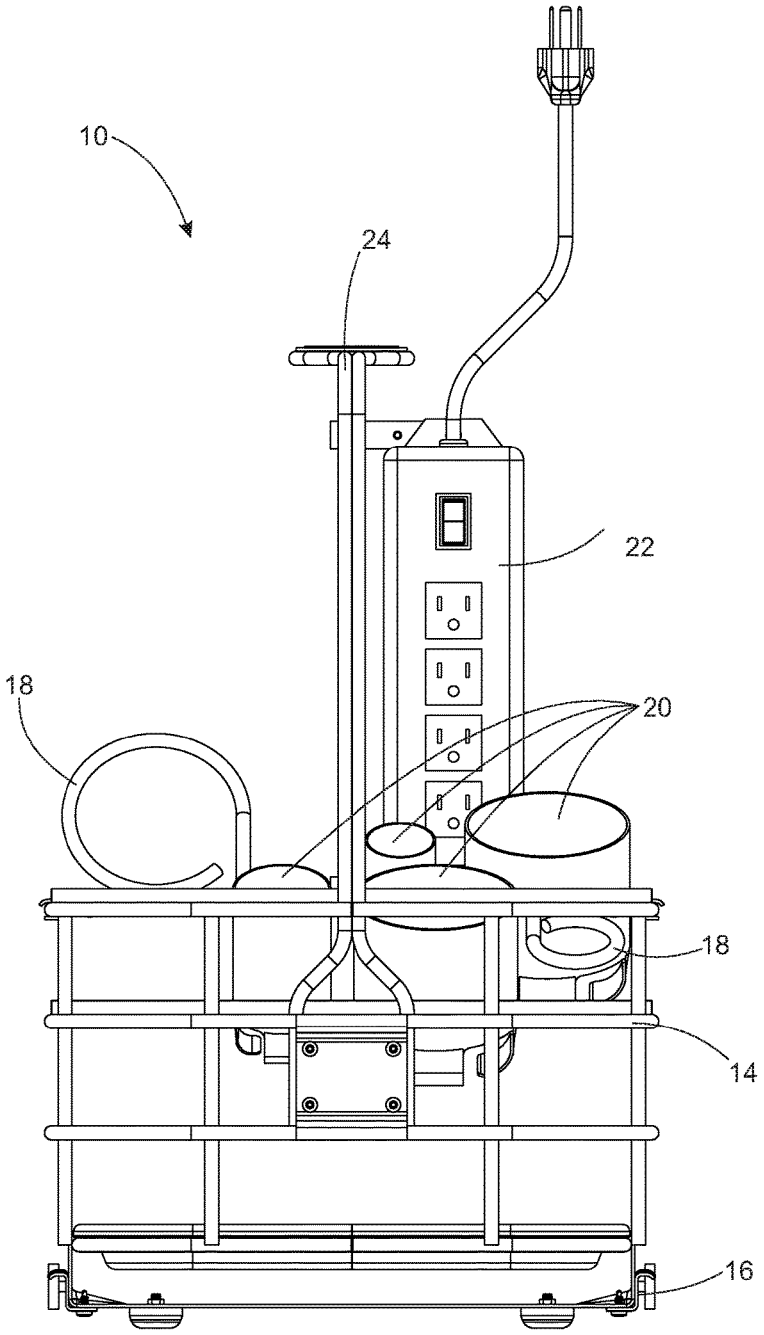
FIG. 4 is a side view of a bathroom appliance storage device, in accordance with an embodiment.

The rack 14 also includes a handle 24. Handle 24 is illustrated as a U-shaped metal handle that extends from one end of the rack 14 to the other. The handle 24 also includes a location shaped to fit a user's hands. The handle 24 always the user to lift the rack 14 from the rest of the bathroom appliance storage device 10 in order to place the rack 14 on a counter or the like. As shown in FIGS. 3 and 4, the rack 14 may include a plurality of feet 60 that are coupled to and extend downward therefrom. The feet 60 enable the rack 14 to rest on a supporting surface, such as a counter, or the like, without any portion of the rack 14, other than the feet 60, coming in contact with the supporting surface. In some embodiments, the feet 60 may be made of a non-slip material, such as rubber, or the like.

The handle 24 may also be multiple handles located on the sides of the rack 14.

In alternate embodiments, the handle 24 may include a padded rubber grip or the like.

The rack 14 may also have a power source 22 coupled to it (see FIG. 4). The power source 22 may be a power strip which is configured to be plugged into an outlet in the bathroom. The power source 22 may be plugged into an outlet in a cabinet where the bathroom appliance storage device 10 is mounted or the power source 22 may be plugged in after the bathroom appliance storage device 10 is moved into a position where the appliances are being used.

In additional embodiments, the power source 22 may be a battery or other portable power source with outlets that allow the appliances to be plugged in and operated.

The rack 14 may also include other storage features such as cord holders which allow the cords of the appliances to be wrapped around the cord holders for storage. Cord holders may be butterfly shaped extensions from the rack 14 or they may be hook shaped or the like. Cord holders may also be clips that hold cords or the like. Cord holders may be any shape or device that holds a cord neatly for storage.

The rack 14 may also include a drawer for holding hair brushes, combs, hair accessories and the like.

The rack 14 may include a mirror that pulls out for use. The mirror may be mounted on a scissor arm which may be pulled out and pushed in depending on the needs of the user. The mirror may also be mounted on a flexible arm that bends in order to allow the user to position the mirror as desired.

The mirror may be a magnifying mirror. The mirror may also be lighted.

The rack 14 is removably coupled to a movable support. The movable support includes a flat support surface on which the rack 14 is removably coupled or set. The rack 14 may snap into place on the flat support surface or may simply set on the surface.

Additionally, the bottom of the rack 14 or the top of the flat support surface may include a friction causing member such as textured rubber or the like which would prevent the rack 14 from sliding off of the flat support surface.

The flat support surface is slidably coupled to at least one track 16. In the embodiment illustrated, the flat support surface is coupled to a thin track which fits inside of the larger track 16. The thin track slides in and out of the larger track 16 allowing the flat support surface to move horizontally.

In alternate embodiments, the flat support surface has rotatable members coupled to the edges of the flat support surface. The rotatable members fit in a groove along the at least one track 16. The rotatable members allow the flat support surface to slide along the at least one track 16.

The track 16 may be coupled inside a drawer or a cabinet 20 as illustrated. The track 16 allows the bathroom appliance storage device 10 to slide horizontally in and out of the cabinet 20.

The cabinet 12 may be any cabinet large enough to hold the bathroom appliance storage device 10.

Figure 5:
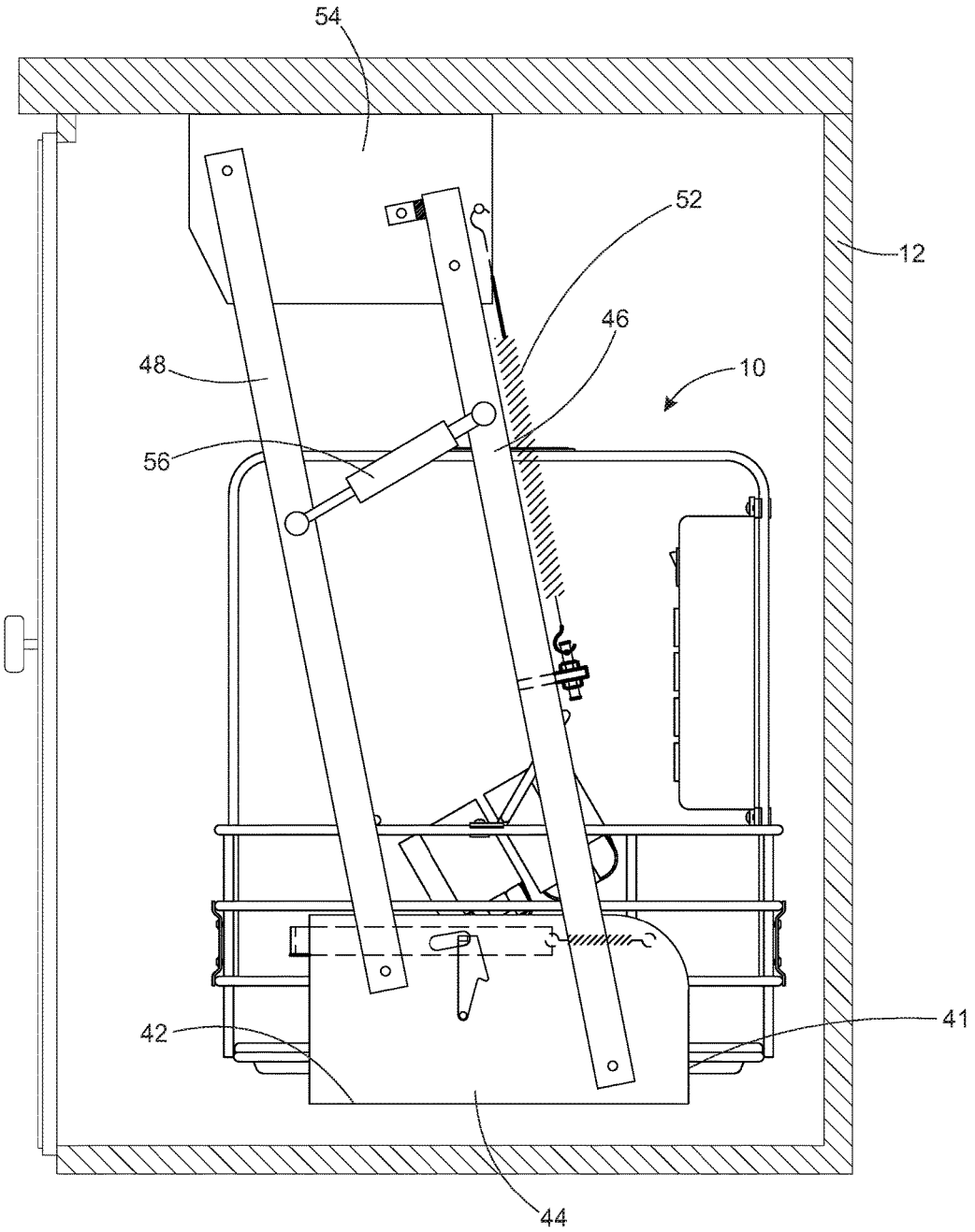
FIG. 5 is a side view of a bathroom appliance storage device coupled to an alternate movement system, in a stowed position, in accordance with an embodiment.

FIG. 5 illustrates an alternate embodiment of a movable support surface 40. The embodiment of the movable support surface 40 illustrated in this figure moves the bathroom appliance storage device in both a vertical and horizontal direction. The bathroom appliance storage device pulls out of the cabinet in a horizontal direction and then rotates in a vertical direction in order to raise the bathroom appliance storage device to a height similar to that of the bathroom counter.

Movable support surface 40 includes a flat support surface 42 on which the rack is removably coupled. The flat support surface 42 is simply a flat thin surface similar to the flat support surface 42 in the previous embodiments. In this embodiment, it is desirable that the rack be coupled to the flat support surface 42 and not simply placed on the flat support surface 42. By coupling the rack to the flat support surface 42, the user may use the handle to move the bathroom appliance storage device from a location inside the cabinet 12 to an elevated location.

An angle member 44 is coupled to the bottom of the flat support surface 42. The angle member 44 is shaped as a right triangle with the 90 degree corner located towards the rear edge 41 of the flat support surface 42. The angle member 44 allows the flat support surface 42 to remain flat as it rotates from inside the cabinet 50 to a height similar to that of the bathroom counter.

A front arm 48 and a rear arm 46 are rotatably coupled to the angle member 44. The front arm 48 and rear arm 46 are positioned so that the flat support surface 42 moves in an arc.

Front arm 48 and rear arm 46 are illustrated as thin bar members or thing rods or the like. Front arm 48 and rear arm 46 may also be formed in any shape or length which allows the flat support surface 42 to follow a desired path.

The other end of the front arm 48 and the rear arm 46 are rotatably coupled to mounting member 54.

Mounting member 54 is illustrated as a partially triangular shaped plate that is mounted to the inside surface of a cabinet 50. Mounting member 54 may be any size or shape that fits on the inside of the cabinet 50 wall and allows the ends of the front arm 48 and the rear arm 46 to be positioned appropriately to cause the flat support surface 42 to follow the desired arc-like path.

A biasing member 52 is coupled to the mounting member 54 and to the rear arm 46. Biasing member 52 as illustrated may be a spring or other stretchable/flexible member that pulls the rear arm 46 towards a default position. The biasing member 52 pulls the rear arm 46 towards both the initial position of the flat support surface 42 and the final position of the flat support surface 42. When in either the initial position where the flat support surface 42 is in the cupboard 50 and the final position where the flat support surface 42 is at its highest position, the biasing member 52 works to keep the flat support surface 42 in place. Additionally, dampening device 56 operates to keep the device from moving quickly and ensures proper orientation between the arms 46 and 48.

In use, the bathroom appliance storage device is mounted inside a drawer, cupboard or cabinet. The bathroom appliance storage device also has multiple bathroom appliances such as blow dryers, curling irons and the like placed in the holder in the rack. The appliances may be plugged into a power source coupled to the rack.

When the user is ready to use the bathroom appliances, the user opens the cabinet door. The user then pulls the bathroom appliance storage device towards a location outside of the cabinet/cupboard which is an open position. The movable support surface slides the rack towards a location outside of the cabinet.

The user may then lift the rack off of the movable support surface by using the handle on the rack. The rack may be placed on the counter in order to allow the user easy access to the contents of the bathroom appliance storage device.

In alternate embodiments, the movable support surface may slide out of the cabinet and then to an elevated position in order to allow the user easy access to the rack.

If the power source is not plugged into an outlet in the inside of the cabinet, the user may need to plug the power source into an outlet once the rack is in an elevated position or on the counter.

Once the user is done with their bathroom appliances, they may be placed back in the holders. Appliances may be placed in the holders while they are still hot.

The power source may also be unplugged.

If the bathroom appliance storage device includes cord holders, the cords may be placed back in the cord holders.

The user may then return the rack to the flat support surface and push the bathroom appliance storage device back into the cabinet to a closed position. In other embodiments, the user may move the bathroom appliance storage device from an elevated location to the inside of the cabinet.

The user may now simply close the cabinet door and the bathroom appliances and products are stored out of sight and in an organized safe manner.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

What is claimed is:

1. A bathroom appliance storage device comprising:
- a movable support;
- a plurality of feet coupled to, and extending downward from, the movable support;
- a rack removably coupled to the moveable support, the rack comprising:
  - a wire basket, the wire basket further comprising:
    - a base of generally rectangular shape removably coupled to the movable support; and
    - four side members coupled to perimeter edges of the base and extending in a same direction away from the base to form an open container shape;
  - a handle having an inverted U-shape, the handle further comprising:
    - an elongated horizontal member; and
    - a pair of elongated vertical members, each of the pair of elongated vertical members being coupled to, and extending downward from, an end of the elongated horizontal member to form the inverted U-shape of the handle, wherein each of the elongated vertical members is fixedly coupled to an opposing side member, respectively, of the four side members;
  - at least one cross member, coupled between opposing side members of the four side members such that the cross member is transverse in orientation to the handle;
  - at least one open ring holder coupled to the at least one cross member;
  - at least one sleeve holder coupled to the at least one cross member, the at least one sleeve holder having a longitudinal axis at an acute nonzero angle with respect to vertical; and
  - a power strip coupled to one of the elongated vertical members of the handle for supplying power to devices storable within the rack; and
- at least one track coupled to the movable support, the at least one track being adapted to slidably engage a corresponding track coupled to an interior surface of a cabinet, wherein the rack is slidable into and out of the cabinet.

2. The bathroom appliance storage device of claim 1, wherein the rack is liftable off of the movable support by use of the handle.

3. A bathroom appliance storage device comprising:
- a movable support; and
- a wire rack removably coupled to the movable support, wherein the rack comprises:
  - a base removably coupled to the movable support;
  - a handle coupled to the base;
  - at least one ring holder coupled to the base;
  - at least one sleeve holder coupled to the base, the at least one sleeve holder having a longitudinal axis at an acute nonzero angle with respect to vertical; and
  - a power source coupled to the handle.

4. The bathroom appliance storage device of claim 3, wherein the moveable support moves horizontally.

5. The bathroom appliance storage device of claim 3, further comprising:
- a horizontal mounting surface of the group that includes the bottom surface of a shelf, the bottom surface of a countertop, and the top interior surface of a cabinet;
- a mounting member coupled to the horizontal mounting surface and extending downward therefrom;
- an elongate front arm, having opposed top and bottom ends, the top end thereof being rotatably coupled to the mounting member;
- an elongate rear arm, having opposed top and bottom ends, the top end thereof being rotatably coupled to the mounting member; and
- an angle member coupled to the movable support and rotatably coupled to the bottom end of the elongate front arm and rotatably coupled to the bottom end of the elongate rear arm, whereby the movable support follows an arc-like path from a stowed position below the horizontal mounting surface to a final position forward of and substantially equal in elevation to the horizontal mounting surface, while maintaining the horizontal mounting surface in a substantially horizontal orientation, in response to a user grasping and pulling the handle.

6. The bathroom appliance storage device of claim 5, further comprising a biasing member coupled thereto, wherein the biasing member tends to maintain the movable support in the stowed position when the movable support is in the stowed position and the biasing member tends to maintain the movable support in the final position when the movable support is in the final position.

7. The bathroom appliance storage device of claim 6, further comprising a dampening device coupled thereto that operates to slow the motion of the movable support as the movable support is transitioned between the stowed position and the final position by a user.

8. The bathroom appliance storage device of claim 3, wherein the rack is liftable off from the movable support.

9. The bathroom appliance storage device of claim 3, further comprising:
- at least one first track coupled to the movable support;
- a cabinet; and
- at least one second track coupled to an interior surface of the cabinet, wherein the at least one first track slidably engages a corresponding at least one second track.

10. A method of using a bathroom appliance storage device, the method comprising:
- providing a bathroom appliance storage device, wherein the bathroom appliance storage device comprises:
  - a movable support; and
  - a wire rack removably coupled to the movable support, wherein the rack comprises:
    - a base removably coupled to the movable support;
    - a handle coupled to the base;
    - at least one ring holder coupled to the base;

at least one sleeve holder coupled to the base, the at least one sleeve holder having a longitudinal axis at an acute nonzero angle with respect to vertical; and a power source coupled to the rack;

providing a cabinet, wherein the bathroom appliance storage device is operationally coupled within the cabinet;

moving the bathroom appliance storage device from a stowed position within the cabinet to a usable position outside of the cabinet;

utilizing at least one bathroom appliance stored within the bathroom appliance storage device; and returning the movable support from the usable position outside the cabinet to the stowed position inside the cabinet.

11. The method of claim 10, wherein the at least one track is slidably coupled to the movable support and coupled to an interior surface of the cabinet.

12. The method of claim 10, wherein the movable support is a drawer.

13. The method of claim 10, further comprising lifting the rack off of the movable support and resting it on a countertop.

14. The method of claim 10, further comprising maintaining bathroom appliances within the bathroom appliance storage device plugged into the power source.

15. The method of claim 14, further comprising supplying power to all of the bathroom appliances within the bathroom appliance storage device in response to plugging the power source into a wall outlet.

16. The method of claim 15, further comprising moving the bathroom appliance device horizontally between the stowed position and the useable position.

17. The bathroom appliance storage device of claim 10, further comprising:

a mounting member coupled to the top interior surface of the cabinet and extending downward therefrom;

an elongate front arm, having opposed top and bottom ends, the top end thereof being rotatably coupled to the mounting member;

an elongate rear arm, having opposed top and bottom ends, the top end thereof being rotatably coupled to the mounting member; and an angle member coupled to the movable support and rotatably coupled to the bottom end of the elongate front arm and rotatably coupled to the bottom end of the elongate rear arm, whereby the movable support follows an arc-like path from a stowed position below the horizontal mounting surface to a final position forward of and substantially equal in elevation to the horizontal mounting surface, while maintaining the horizontal mounting surface in a substantially horizontal orientation, in response to a user grasping and pulling the handle.

18. The bathroom appliance storage device of claim 17, further comprising a biasing member coupled thereto, wherein the biasing member tends to maintain the movable support in the stowed position when the movable support is in the stowed position and the biasing member tends to maintain the movable support in the final position when the movable support is in the final position.

19. The bathroom appliance storage device of claim 18, further comprising a dampening device coupled thereto that operates to slow the motion of the movable support as the movable support is transitioned between the stowed position and the final position by a user.

20. The method of claim 10, wherein the at least one bathroom appliance utilized is one of a hot iron, or a heating blow dryer, the method further comprising returning the at least one bathroom appliance to its stored position within the bathroom appliance storage device while the at least one bathroom appliance is at its fully-heated operating temperature.

* * * * *